US007322683B2

(12) United States Patent
Youngberg

(10) Patent No.: US 7,322,683 B2
(45) Date of Patent: Jan. 29, 2008

(54) SYSTEM AND A METHOD FOR ON-AXIS SEPARATE INK AND SILICON INK DELIVERY

(75) Inventor: Daniel W Youngberg, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 375 days.

(21) Appl. No.: 10/976,554

(22) Filed: Oct. 29, 2004

(65) Prior Publication Data

US 2005/0174399 A1 Aug. 11, 2005

Related U.S. Application Data

(60) Provisional application No. 60/543,137, filed on Feb. 9, 2004.

(51) Int. Cl.
*B41J 2/175* (2006.01)
*B41J 2/17* (2006.01)

(52) U.S. Cl. ..... 347/85; 347/84

(58) Field of Classification Search ..... 347/84, 347/85, 86
See application file for complete search history.

(56) References Cited

U.S. PATENT DOCUMENTS

| | | | | |
|---|---|---|---|---|
| 4,342,041 | A * | 7/1982 | Kasugayama et al. | 347/85 |
| 4,417,258 | A * | 11/1983 | Tribolet et al. | 346/139 R |
| 4,716,420 | A * | 12/1987 | Glassett | 346/139 R |
| 4,920,357 | A * | 4/1990 | Johnson | 346/49 |
| 5,900,896 | A * | 5/1999 | Barinaga et al. | 347/86 |
| 6,269,744 | B1 * | 8/2001 | Blaser et al. | 101/494 |
| 6,644,781 | B2 | 11/2003 | Silverbrook | |
| 6,648,457 | B2 | 11/2003 | Smith | |
| 6,663,234 | B2 | 12/2003 | Roof | |
| 2002/0167574 | A1 * | 11/2002 | Shinada et al. | 347/86 |
| 2002/0191038 | A1 * | 12/2002 | Tsuji | 347/5 |
| 2003/0210309 | A1 * | 11/2003 | Kimura et al. | 347/85 |
| 2004/0165044 | A1 * | 8/2004 | Yamada | 347/86 |

* cited by examiner

*Primary Examiner*—Stephen Meier
*Assistant Examiner*—Rene Garcia, Jr.

(57) ABSTRACT

A system providing ink to a printing device includes a carriage including a fluid interconnect probe, a plurality of ink supply cartridges, and an autoloader configured to fluidly couple one of the ink supply cartridges to the carriage.

35 Claims, 7 Drawing Sheets

SYSTEM AND A METHOD FOR ON-AXIS SEPARATE INK AND SILICON INK DELIVERY

RELATED APPLICATIONS

This application claims priority of U.S. Provisional Application Ser. No. 60/543,137, "A System and a Method for On-Axis Separate Ink and Silicon Ink Delivery", filed Feb. 9, 2004.

BACKGROUND

Inkjet printing mechanisms use cartridges, often called "pens," which eject drops of liquid colorant, referred to generally herein as "ink," onto a page. Each pen has a printhead formed with very small nozzles through which the ink drops are fired. Although not completely, strictly accurate, practitioners often refer to the whole printhead assembly as "silicon". The terminology "separate ink and silicon" refers to a system where the primary ink reservoir is not a permanent part of the printhead assembly. To print an image, the printhead is propelled back and forth across the page, selectively ejecting drops of ink in a desired pattern. The ink ejection mechanism within the printhead may take on a variety of different forms known to those skilled in the art, such as those using piezo-electric or thermal printhead technology.

Early inkjet printers used a single monochromatic pen, typically carrying black ink. Later generations of inkjet printing mechanisms used a black pen which was interchangeable with a tri-color pen, typically one carrying the colors of cyan, magenta, and yellow within a single cartridge. The tri-color pen printed a "process" or "composite" black image, by depositing drops of cyan, magenta, and yellow inks all at the same location. The next generation of printers further enhanced the images produced by using either a dual pen system or a quad pen system. The dual pen printers had a black pen and a tri-color pen mounted in a single carriage to print crisp, clear black text while providing full color images.

The quad pen printing mechanisms had four separate pens that carried black ink, cyan ink, magenta ink, and yellow ink. Quad pen plotters typically carried four pens in four separate carriages. Similarly, quad pen desktop printers were designed to carry four cartridges in a single carriage, each cartridge and pen adding to the weight of the inkjet printing mechanisms.

As the number of pens incorporated by inkjet printing mechanisms increased, the cost and size of the inkjet printing mechanisms also increased due to the increased quantity of ink contained by the cartridges. In order to carry enough ink for high ink use applications, the carriage must be large enough to carry large (10 or more cc's) ink supply cartridges of all colors. This requires significant power to move the carriage and large printer size to accommodate the volume of the carriage; each of these factors increasing the cost of the printer. Recently, efforts have been made to reduce the cost and size of ink-jet printers.

However, reducing the cost and size of inkjet printers by reducing the volume of ink supplied to each pen limits the inkjet printers to small print jobs and increases the frequency of ink replacement. Furthermore, whenever an ink supply cartridge on a low volume inkjet printer is emptied, direct operator intervention is required before printing can resume.

Consequently, different carriage designs have been implemented to optimally address high and low ink use applications. When incorporating expensive large printers, valuable space on a user's desktop is consumed. However, when incorporating smaller printers, ink replacement is frequently needed demanding direct intervention by a user. Moreover, addressing various ink usage rates with multiple ink supply cartridge sizes is costly since production lines must be designed to accommodate multiple cartridge sizes, inventories of raw materials and production plans must be managed, and the distribution system must manage multiple stock keeping units (SKU's).

SUMMARY

A system providing ink to a printing device includes a carriage including a fluid interconnect probe, a plurality of ink supply cartridges, and an autoloader configured to fluidly couple one of the ink supply cartridges to the carriage.

BRIEF DESCRIPTION OF THE DRAWINGS

The accompanying drawings illustrate various embodiments of the present method and system and are a part of the specification. The illustrated embodiments are merely examples of the present system and method and do not limit the scope thereof.

Throughout the drawings, identical reference numbers designate similar, but not necessarily identical, elements.

DETAILED DESCRIPTION

A method and an apparatus for providing ink to an on-axis separate ink and silicon ink delivery system are described herein. More specifically, a system is described for providing one or more ink supply cartridges to a carriage assembly incorporating one or more printheads in order to replenish a diminished ink supply. According to one exemplary embodiment, the ink supply cartridge(s) may be automatically supplied to the carriage assembly by an auto loading mechanism thereby eliminating the need for user intervention. Additionally, an empty cartridge holding bin is included according to one exemplary embodiment, to collect empty ink supply cartridges after they have been exhausted. A number of exemplary structures and methods of the present ink delivery system are described in detail below.

As used in this specification and in the appended claims, the term "ink" is meant to be understood broadly as any jettable fluid, with or without dye, which may be selectively ejected by any number of inkjet printing devices. Additionally, the term "jettable" is meant to be understood as a fluid that has characteristics such as a viscosity suitable for precise ejection from an inkjet printing device. Moreover, the term "on-axis" is meant to be understood broadly as any printing device that stores a residual amount of ink on the carriage itself, resulting in a translation of the residual ink along with the carriage during operation.

In the following description, for purposes of explanation, numerous specific details are set forth in order to provide a thorough understanding of the present system and method for providing an on-axis separate ink and silicon ink delivery system. It will be apparent, however, to one skilled in the art that the present method may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

EXEMPLARY STRUCTURE

Figure 1:
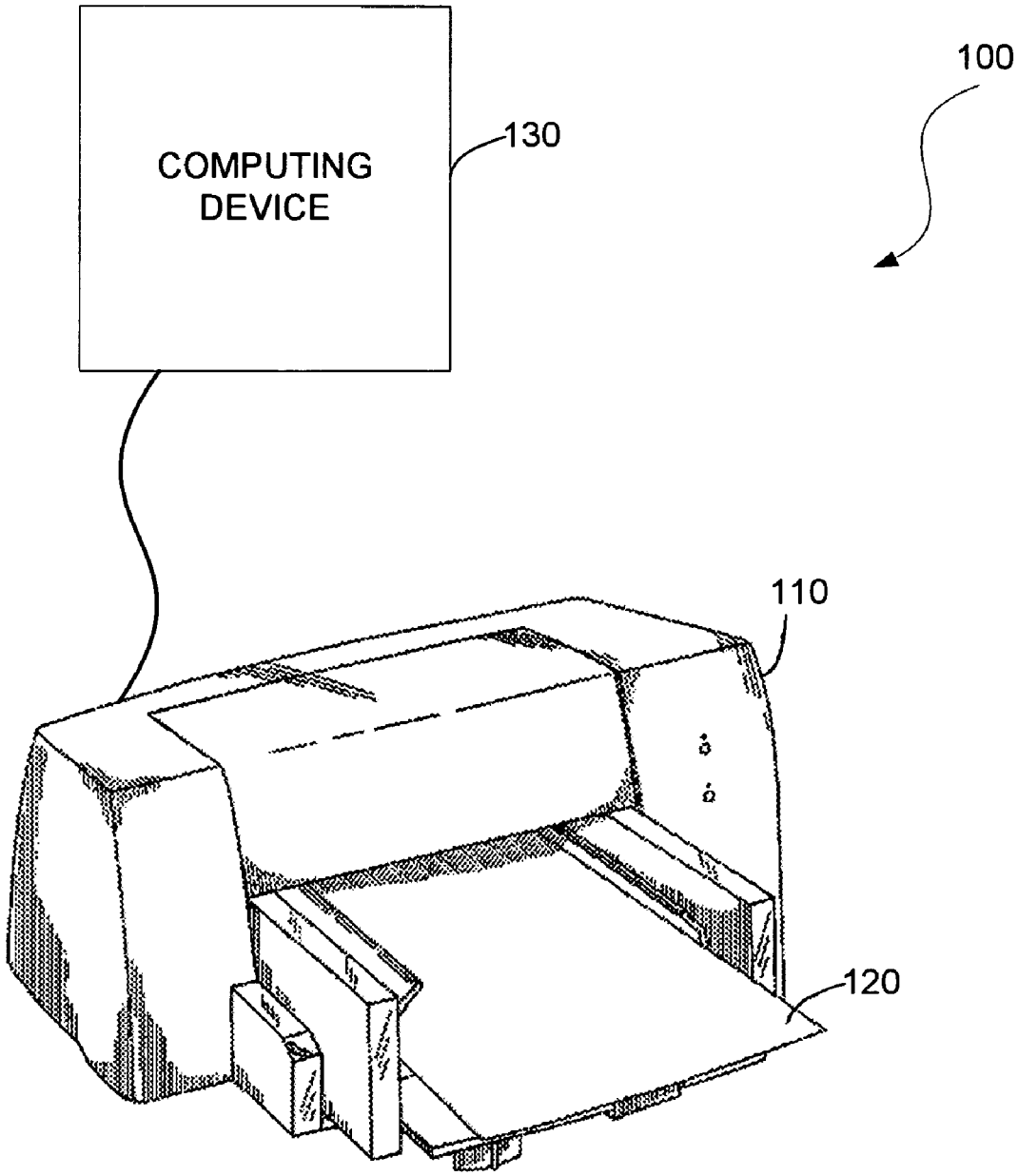
FIG. 1 is simple block diagram illustrating an inkjet printing system according to one exemplary embodiment.

FIG. 1 illustrates an inkjet printing system (100) configured to incorporate the present on-axis ink delivery system according to one exemplary embodiment. As show in FIG. 1, an inkjet printing system (100) may include an inkjet printer (110) and a print medium (120) disposed on the inkjet printer (110). The inkjet printer (110) of the inkjet printing system (100) illustrated in FIG. 1 may be any shape or size sufficient to house an inkjet material dispenser and any associated hardware necessary to perform the present inkjet printing method. The inkjet printer (110) may contain one or more material dispensers, print medium positioning rollers or belts, servo mechanisms, and/or computing devices as will be further described in detail below with reference to FIG. 2.

The inkjet printing system (100) may generate and/or receive a print job from a communicatively coupled computing device (130) wherein the print job includes a digital description of a desired image. The print job may be converted into motion and dispensing commands that may then be used by the inkjet printer (110) to deposit liquid image forming material on the print medium (120) to form a desired image. The method described herein may be applied by any inkjet material dispenser incorporated by the inkjet printer illustrated in FIG. 1 when dispensing liquid image forming material. The inkjet material dispenser employed by the inkjet printer (100) to perform the present method may be any inkjet capable of performing print on demand applications including, but in no way limited to, thermally activated inkjet material dispensers, mechanically activated inkjet material dispensers, electrically activated inkjet material dispensers, magnetically activated material dispensers, and/or piezoelectrically activated material dispensers. Additionally, any number of print mediums (120) may be used by the present system and method including, but in no way limited to, paper, plastic, transparencies, or fabric.

Figure 2:
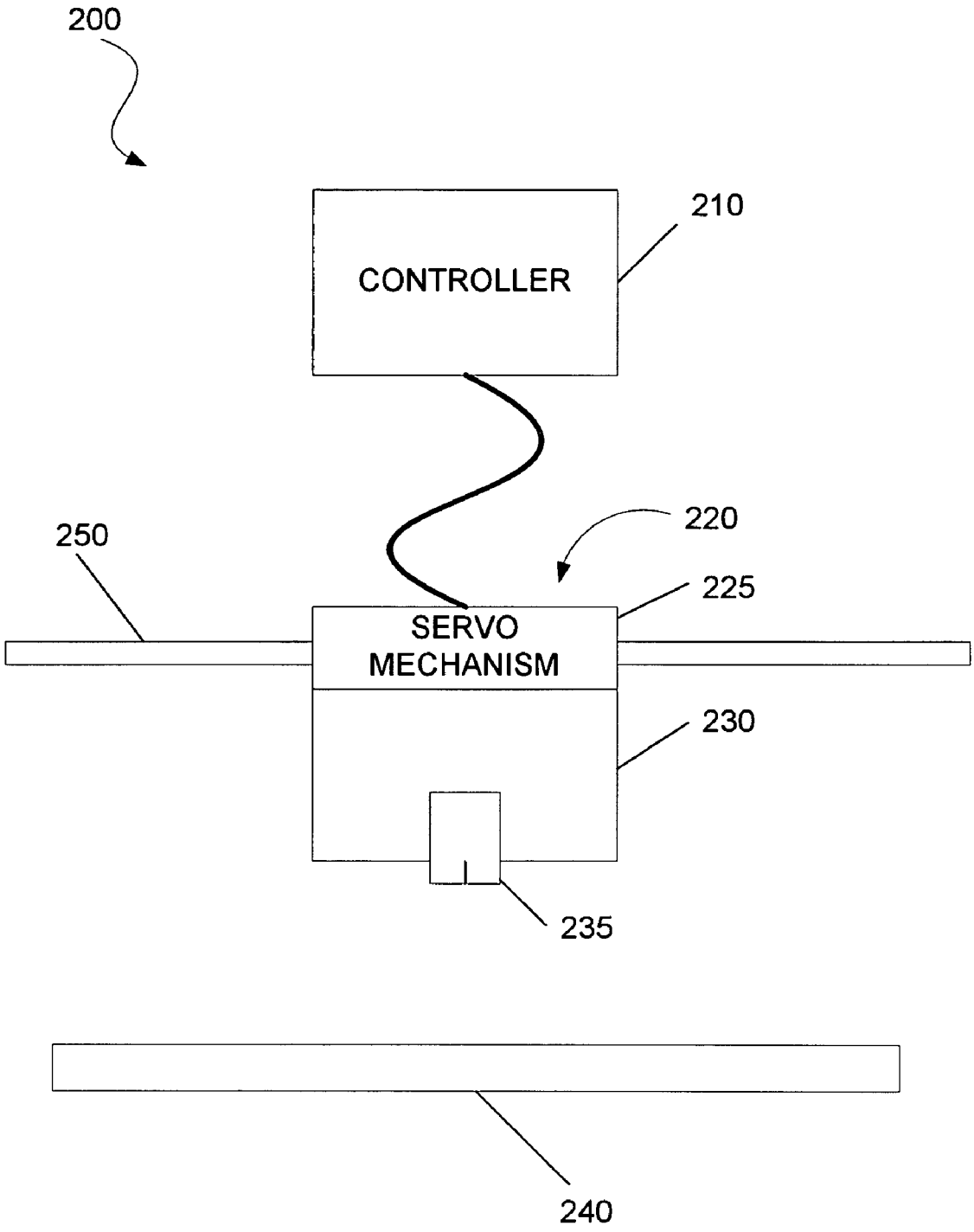
FIG. 2 is a simple block diagram illustrating the internal components of an inkjet printing system according to one exemplary embodiment.

FIG. 2 further illustrates the components of an inkjet printer according to one exemplary embodiment. As illustrated in FIG. 2, an inkjet printer (200) may include a computing device (210) communicatively coupled to a servo mechanism (225) that controls a pen (220). The computing device (210) may communicate commands to the servo mechanism (225) causing it to selectively position the carriage assembly (230). The servo mechanism (225) may be any number of motors, belts, and/or gears configured to selectively and accurately position the carriage assembly (230) upon receiving commands from the computing device (210). The motors, belts, and/or gears may be further aided in their positioning of the pen (220) by a stabilizer bar (250) configured to stabilize and guide the travel of the pen (220). Additionally, the servo mechanism (225) of the present exemplary inkjet printer (200) may form a part of the pen (220) as illustrated in FIG. 2 or may be controllably coupled to the pen (220) assembly through a number of belts and/or gears.

The pen assembly (220) of the inkjet printer (200) illustrated in FIG. 2 may include a moveable carriage assembly (230) having one or more inkjet printheads (235) coupled thereto. The moveable carriage assembly (230) is controllably coupled to the servo mechanism (225) such that the servo mechanism may selectively position the moveable carriage assembly (230) in response to commands received from the computing device (210). The one or more printheads (235) coupled to the moveable carriage assembly (230) may include, but are in no way limited to, thermally activated inkjet material dispensers, mechanically activated inkjet material dispensers, electrically activated inkjet material dispensers, magnetically activated material dispensers, and/or piezoelectrically activated material dispensers.

Additionally, the pen assembly (220) may include a number of on-axis material reservoirs (not shown) configured to supply ink to the inkjet printheads (235). Once positioned by the servo mechanism (225), the pen (220) may controllably eject a desired ink supplied by the on-axis material reservoir. The ink that is selectively ejected by the pen (220) may be deposited onto a desired print medium (120; FIG. 1) that has been positioned adjacent to the print head (235) by a print medium transport (240). The print medium transport (240) may be any number of belts and/or rollers configured to selectively position a print medium (120; FIG. 1) adjacent to the print head (235).

Figure 3:
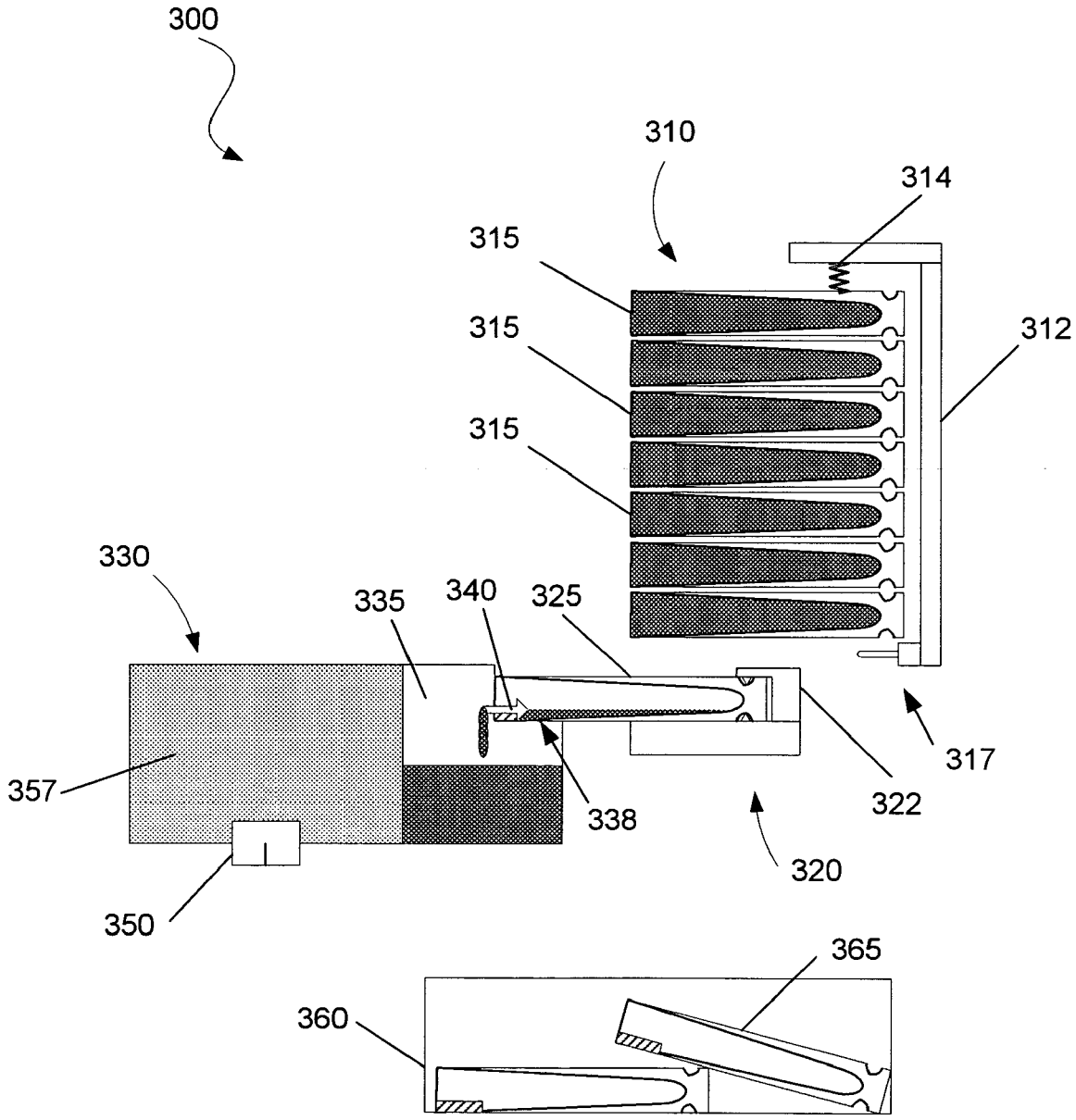
FIG. 3 is a simple block diagram illustrating the components of an ink supply apparatus according to one exemplary embodiment.

FIG. 3 illustrates an ink supply system (300) that may be used, according to one exemplary embodiment, to provide an on-axis ink delivery system. As illustrated in FIG. 3, the present ink supply system (300) includes an ink supply cartridge stack (310) containing a number of ink supply cartridges (315). According to the exemplary embodiment illustrated in FIG. 3, the ink supply cartridge stack (310) is disposed above an autoloader (320) such that when desired, the independent ink supply cartridges (315) may be fed into the autoloader and subsequently to a moveable carriage assembly (330). The ink supply cartridge (315) may be selectively fed to the autoloader (320) by a force such as gravity or a translational spring force exerted upon the ink supply cartridges (315) by a spring (314) forming a part of an ink supply magazine (312). Release of the independent ink supply cartridges (315) from the ink supply magazine (312) may be controlled by, according to one exemplary embodiment, an escapement mechanism (317) such as an electrically controlled solenoid. As illustrated in FIG. 3, the ink supply system (300) may also include an empty cartridge holding bin (360) disposed below the autoloader (320) such that it may catch and contain a number of empty ink supply cartridges (365) after they have replenished an ink reservoir (335). The individual elements of the present ink supply system (300) will now be described in further detail below.

As illustrated in FIG. 3, the ink supply cartridge stack (310) is made up of a plurality of ink supply cartridges (315) stacked on top of one another. According to one exemplary embodiment, the ink supply cartridges (315) are arranged in the printer body of an inkjet printer (110; FIG. 1) such that gravity may enable the feeding of full ink supply cartridges (315) into the carriage assembly (330) by the autoloader (320). According to the exemplary embodiment illustrated in FIG. 3, an inkjet printer (110; FIG. 1) may include an ink supply magazine (312) including a linear spring (314) configured to apply a linear force on the ink supply cartridge stack (310). As illustrated in FIG. 3, the ink supply magazine (312) may also include an escapement mechanism (317) configured to retain the new ink supply cartridges (315) in the ink supply magazine (312) until the pierced ink supply cartridge (325) is extracted from the autoloader mechanism (320). Moreover, according to one exemplary embodiment, the ink supply magazine (312) may either be molded into the case of the ink jet printer (110) or be a removable spring-loaded magazine. Regardless of the form of the ink supply magazine (312), it will include stack walls that assure proper orientation of the new ink supply cartridges (315). Additionally, according to one exemplary embodiment, the ink supply magazine (312) may be configured to hold a plurality of ink supply cartridges (315) to be fed to multiple carriage assemblies using the autoloader mechanism (320).

The autoloader mechanism (320) used in the present exemplary embodiment is configured to controllably remove empty ink supply cartridges (365) from the carriage assembly (330) and move them to the empty cartridge holding bin (360). Additionally, the autoloader mechanism (320) is configured to select full ink supply cartridges (315) from the ink supply cartridge stack (310) and supply the full ink supply cartridges (315) to the carriage assembly (330) so as to complete the fluid interconnect. The autoloader mechanism (320) may be any device that may be controllably translated so as to selectively move ink supply cartridges (315) in and out of contact with a carriage assembly (330). According to one exemplary embodiment, the autoloader mechanism (320) includes a plate having a cartridge grasping extrusion (322) thereon as illustrated in FIG. 3. According to the exemplary embodiment illustrated in FIG. 3, the autoloader mechanism (320) may function similar to cartridge securing mechanisms used in firearms. As shown in FIG. 3, the cartridge grasping extrusion (322) may have a number of small pins or extrusions that are configured to retain the base of the ink supply cartridges (315) until it is extinguished, and a discharge pin configured to eject used cartridges.

According to one exemplary embodiment, the autoloader mechanism (320) is linearly translated due to an actuation of a solenoid or other linearly translating device. Alternatively, the autoloader mechanism (320) may receive power for operation from any number of devices including, but in no way limited to, a function-specific motor, a number of belts, gears, cams, and/or shafts coupled to the servo mechanisms (225; FIG. 2).

Also illustrated in FIG. 3, the autoloader mechanism (320) selectively provides and removes ink supply cartridges (315) from a carriage assembly (330). According to the exemplary embodiment illustrated in FIG. 3, the carriage assembly (330) may include an ink reservoir (335) having an ink supply cartridge reception recess (338). The ink supply cartridge reception recess (338) is configured to receive and seat an ink supply cartridge (315) such that a fluid interconnect probe (340) coupled to the ink reservoir (335) may pierce the ink supply cartridge (315). The ink supply cartridge (315) may be provided by either a user or an autoloader mechanism (320) as explained above. The fluid interconnect probe (340) is an extrusion including a lumen that extrudes from the face of the ink supply cartridge reception recess (338) so that it may pierce a provided ink supply cartridge (315) when inserted by a user or an autoloader mechanism (320). FIG. 3 illustrates a pierced ink cartridge (325) providing ink to the ink reservoir (335). According to one exemplary embodiment, one fluid interconnect probe (340) and one ink reservoir (335) is provided for each color of the carriage assembly (330). A lumen or other manifold system is also present in the carriage assembly (330), according to one exemplary embodiment, to allow ink to flow from the pierced ink supply cartridge (325), to the ink reservoir (335). From the ink reservoir (335), the ink is allowed to flow to an intermediate printhead ink supply (357) before being fed to the printhead (350) for selective emission.

The pierced ink supply cartridge (325) may remain temporarily attached to the on-axis pen assembly even during printing operations. Once the pierced ink supply cartridge (325) has been emptied, it is removed, either manually by a user or by the autoloader mechanism (320). According to one exemplary embodiment, a number of sensors (not shown) may be incorporated into the present system and method to determine when the pierced ink supply cartridge (325) has been emptied including, but in no way limited to, one or more flow sensors disposed at the fluid interconnect. When vacant, the empty cartridges (365) may be discarded into an empty cartridge holding bin (360) disposed within the inkjet printer (200; FIG. 2). The empty cartridge holding bin (360), according to the present exemplary embodiment, may vary in size to accommodate the size limitations associated with various inkjet printers.

Figure 4:
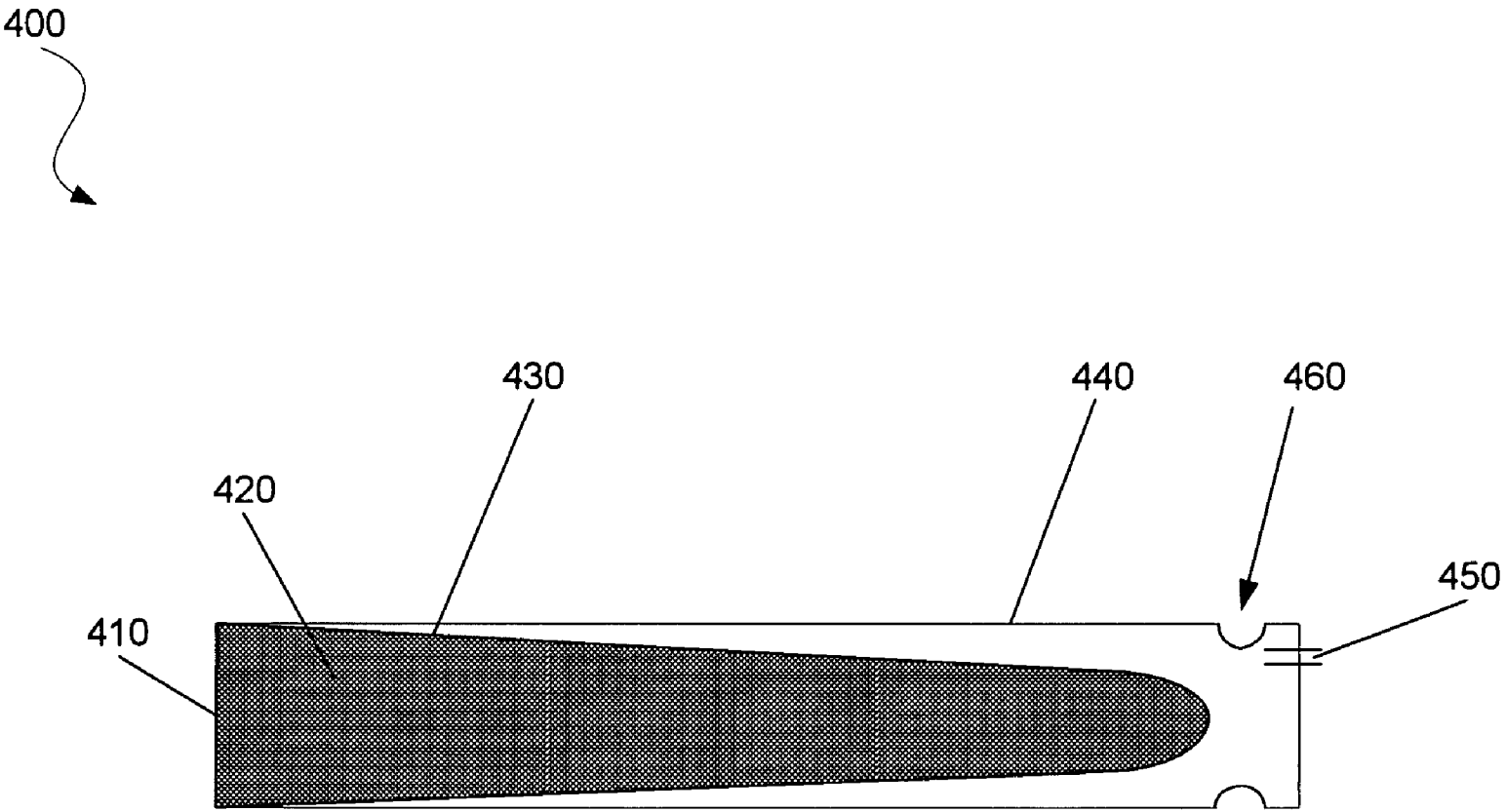
FIG. 4 is a simple block diagram illustrating the individual components of an ink supply cartridge according to one exemplary embodiment.

The ability to accommodate high ink use applications while reducing carriage mass and power consumption is in large part attributable to the characteristics of the ink supply cartridges (315). FIG. 4 illustrates a cross-sectional view of the elements of an ink supply cartridge (400) according to one exemplary embodiment. As illustrated in FIG. 4, the present exemplary ink supply cartridge (400) includes a cylindrically shaped rigid shell (440) having a pierceable septum cap (410) disposed at one end and a lip formed by a groove (460) formed in the base of the rigid shell (440). Moreover, a vent (450) is disposed in the rigid shell (440) of the ink supply cartridge (400). A bladder (430) containing ink (420) held in a vacuum condition is substantially contained by the rigid shell (440) and the septum cap (410).

According to one exemplary embodiment, the cylindrically shaped rigid shell (440) may be made of any number of rigid materials including, but in no way limited to, thermoplastics, glass, liquid crystal polymer (LCP), or polyphenylene sulfide (PPS). While the present exemplary ink supply cartridge (400) is described in the context of a cylindrically shaped enclosure, any number of geometries may be used to form the rigid shell (440). As illustrated in FIG. 4, the rigid shell (440) may also include a lip formed by a circumferential groove (460). The groove (460) is configured to engage with the cartridge grasping extrusion (322; FIG. 3) that forms a part of the autoloader mechanism (320; FIG. 3). Additionally, according to one exemplary embodiment, the ink supply cartridge (400) may be a cylinder 3 centimeters in length having a diameter of 1.5 centimeters. According to this exemplary embodiment, the ink supply cartridge (400) is capable of housing from 2 cubic centimeters (cc) to 5 (cc) of ink (420). By providing multiple small ink supply cartridges (400) rather than a single large ink cartridge to the carriage assembly (330; FIG. 3), high ink use applications may be accommodated while reducing carriage mass and power consumption. Additionally, the rigid shell (440) of the present ink supply cartridge may incorporate human and/or machine readable information to identify the color and/or characteristics of the ink (420) contained therein.

The bladder (430) containing the ink (420) and the pierceable septum cap (410) may both be made of rubber or other similar elastic materials. Additionally, the pierceable septum cap (410) may also include a foil outer layer to eliminate water vapor transmission.

The ink (420) contained in the bladder (430) of the ink supply cartridge (400) illustrated in FIG. 4 is used to replenish the ink reservoir (335; FIG. 3) of the moveable carriage (330; FIG. 3) according to one exemplary embodiment. As mentioned previously, the ink (420) is kept in a vacuum condition within the bladder (430). By keeping the ink (420) in a vacuum condition within the bladder (430), a pressure differential is created between the air occupying the rigid shell (440) introduced through the vent (450) and the ink (420) contained within the bladder (430). Accordingly, when the pierceable septum cap (410) is pierced, the pressure differential will cause a rapid surge of ink through the hollow fluid interconnect probe (340; FIG. 3), thereby allowing for a rapid replenishing of the ink reservoir (335; FIG. 3) of the carriage assembly (330; FIG. 3).

By incorporating a universal ink supply cartridge (400), the present system and method allows one carriage assembly (330; FIG. 3) design to be profitably used in both high and low ink use applications. In a low cost, low ink usage printing device, the autoloader mechanism (320; FIG. 3) may be eliminated and an operator may be prompted to replace the ink supply cartridges (400) when empty. Additionally, the identical carriage design may be incorporated into a higher cost, high ink usage printer through the addition of the autoloader mechanism (320; FIG. 3). The incorporation of the autoloader mechanism (320; FIG. 3) allows several ink supply cartridges (400) to be stacked in the printing device where they may be selectively accessed. This capability allows a large quantity of ink (420) to be available to the carriage assembly without direct intervention by a user and without adding weight to the carriage assembly (330; FIG. 3).

Additionally, the present system and method allow for the manufacture of very small printers. Not only are the ink supply cartridges (400) very small, thereby occupying very little space, but the size of the carriage drive motor and other servo mechanisms can be reduced because they are moving less mass when compared to traditional ink delivery systems. This reduction in mass and associated reduction in size also reduces the amount of overtravel required to accurately position the carriage assembly (330; FIG. 3). Reduced size in the carriage drive motor and other servo mechanisms, as well as in the amount of case material, reduces overall cost of the printing device.

Moreover, the incorporation of a single universal ink supply cartridge (400) for all applications reduces ink supply manufacturing costs. By incorporating a single, universal ink supply cartridge size (400) in both high ink use applications and low ink use applications, manufacture of the ink supply cartridges (400) may be streamlined.

EXEMPLARY IMPLEMEMTATION AND OPERATION

Figure 5:
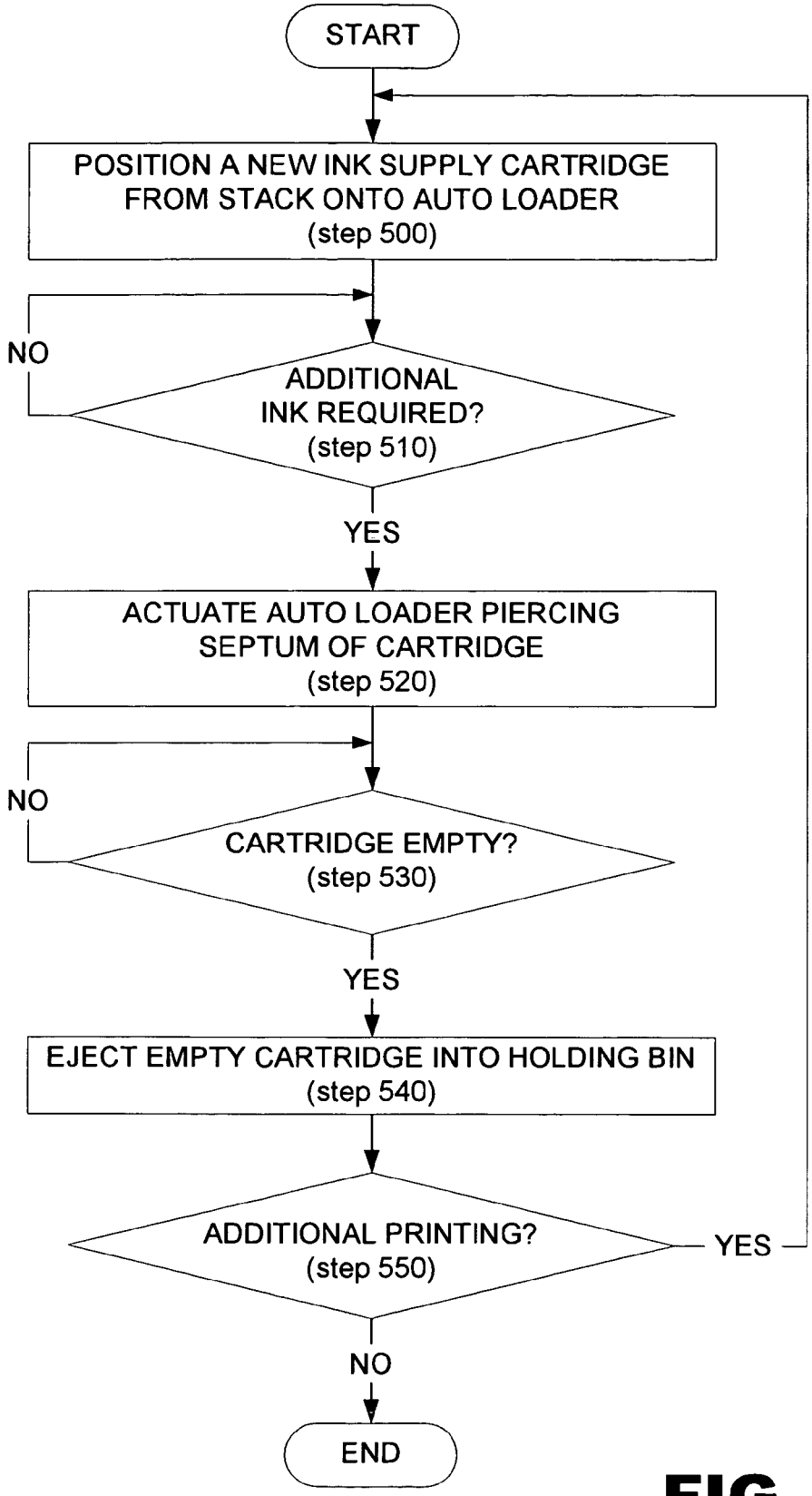
FIG. 5 is a flow chart illustrating a method for supplying ink to an ink-jet print head using an on-axis ink delivery system according to one exemplary embodiment.

FIG. 5 is a flow chart illustrating a method for incorporating the present ink supply system (300; FIG. 3) into an inkjet printer according to one exemplary embodiment. As illustrated in FIG. 5, the present system and method begin by first positioning a new ink supply cartridge (400; FIG. 4) from the ink supply cartridge stack (310; FIG. 3) onto an autoloader (step 500). The positioning of a new ink supply cartridge (400; FIG. 4) from the ink supply cartridge stack (310) onto the autoloader (step 500) may be either gravity induced or mechanically induced by a spring or actuator.

Regardless of the method used to position the new ink supply cartridge onto the autoloader (step 500), once the new ink supply cartridge (400; FIG. 4) is on the autoloader (320; FIG. 3) the computing device controlling the inkjet printer determines whether additional ink is desired in the carriage assembly (step 510). The determination of whether additional ink is desired in the carriage assembly (330; FIG. 3) can be made by the computing device (130; FIG. 1) based on, but in no way limited to, an amount of ink that has been printed as indicated by a volume of pixels rendered or by a number of sensors present on the carriage assembly (330; FIG. 3). If the computing device determines that no additional ink is desired in the carriage assembly (NO, step 510), the computing device continues to monitor for a condition warranting additional ink.

If, however, the computing device determines that additional ink is desired in the carriage assembly (YES, step 510), the autoloader (320) is actuated to cause the ink supply cartridge (315; FIG. 3) to be thrust into the ink supply cartridge reception recess (338; FIG. 3) where the fluid interconnect probe (340) pierces the septum cap (410; FIG. 4) of the ink supply cartridge (step 520). Once the septum cap (410; FIG. 4) is pierced, the pressure differential that exists within the ink supply cartridge (315; FIG. 3) forces the ink (420; FIG. 4) out of the bladder (430; FIG. 4) of the ink supply cartridge (400; FIG. 4) and into the ink reservoir (335; FIG. 3) of the carriage assembly (330; FIG. 3). Alternatively, a plurality of needles or probes may be present on the ink supply cartridge reception recess (338; FIG. 3). According to this exemplary embodiment, a vent (450, FIG. 4) may allow air to enter the ink supply cartridge (400; FIG. 4) while a probe acts as a fluid interconnect between the ink supply cartridge (400; FIG. 4) and the ink reservoir (335; FIG. 3).

After the autoloader has been actuated to pierce the septum cap of the ink supply cartridge (step 520), the computing device determines whether the ink supply cartridge (400; FIG. 4) has been emptied (step 530). Determination of the amount of ink remaining in the ink supply cartridge (400; FIG. 4) may be made according to any number of methods including but in no way limited to the completion of a time period initiated upon the insertion of the fluid interconnect probe (340; FIG. 3) into the ink supply cartridge (400; FIG. 4), the amount of ink that has flowed through the fluid interconnect probe (340) as determined by a number of sensors, and/or the weight of the ink supply cartridge (400; FIG. 4).

When the computing device determines that the ink supply cartridge is empty (YES, step 530), the autoloader (320) is caused to eject the empty ink supply cartridge (400; FIG. 4) into the empty cartridge holding bin (step 540). The ejection of the empty ink cartridge (365) may be accomplished by any number of mechanical means including, but in no way limited to, an ejection pin that forms a part of the ink supply system or by merely moving the autoloader (320; FIG. 3) so that it is no longer in contact with or otherwise supporting the ink supply cartridge (400; FIG. 4).

Upon ejection of an empty ink supply cartridge into the holding bin (step 540), the computing device determines whether additional printing is to be performed (step 550). If additional printing is to be performed (YES, step 550), additional ink may be desired in the carriage assembly (330;

FIG. 3) and the present method begins again by positioning a new ink supply cartridge (315; FIG. 3) from the ink supply cartridge stack (310; FIG. 3) onto the autoloader mechanism (step 500). If, however, no additional printing is to be performed by the printing device (NO, step 550), the present method is ended and the autoloader remains empty until the present method is again initiated by the printing device. By incorporating small ink supply cartridges (315; FIG. 3) that are only pierced and incorporated into the carriage assembly (330; FIG. 3) when required for printing a desired image, excessive and/or premature drying of the ink supply is avoided. This elimination of premature drying enhances the number of images that may be produced by each ink supply cartridge (315; FIG. 3).

ALTERNATIVE EMBODIMENTS

Figure 6:
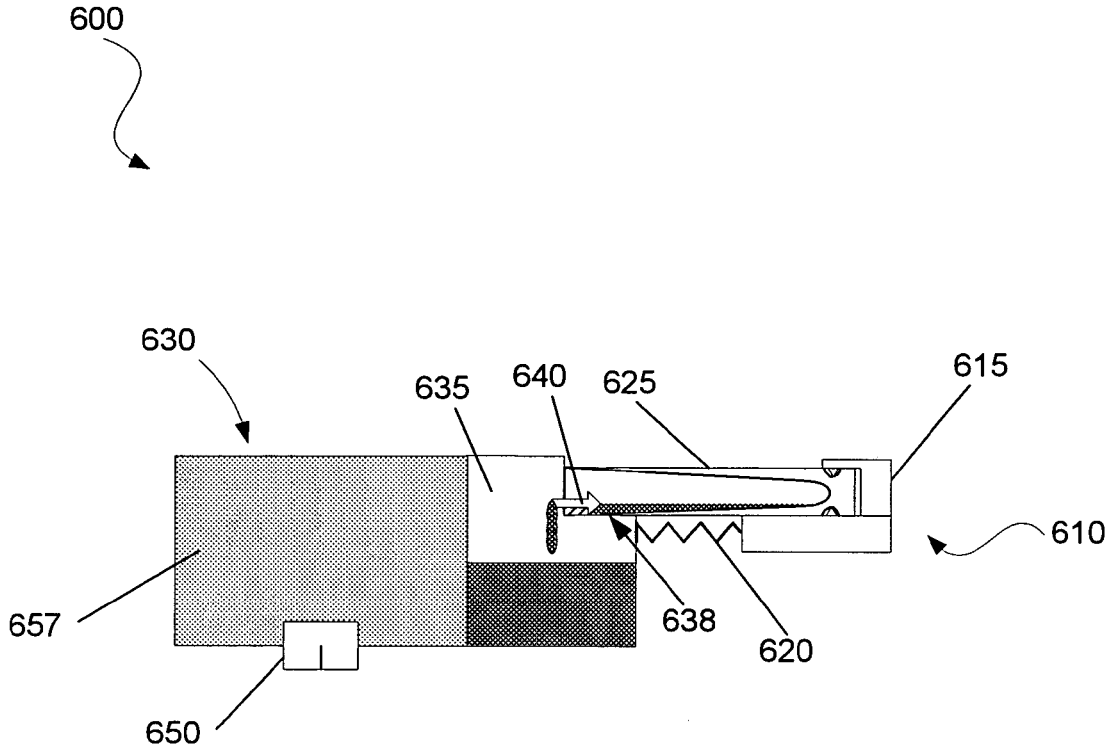
FIG. 6 is a simple block diagram illustrating the supplying of an ink to an ink-jet print head using an on-axis ink delivery system according to one exemplary embodiment.

According to one alternative embodiment illustrated in FIG. 6, the present ink supply system (600) may be implemented at a reduced cost by removing the autoloader (320; FIG. 3) and the empty cartridge holding bin (360) from the system. According to the exemplary embodiment illustrated in FIG. 6, the manual ink supply system (600) includes a carriage assembly (630) having an ink reservoir (635) in fluid communication with a fluid interconnect probe (640) similar to that illustrated in FIG. 3 as explained above. Additionally, a print head ink supply (657) is in fluid communication with both the ink reservoir (635) and a print head (650).

However, in contrast to the ink supply system illustrated in FIG. 3, the present exemplary embodiment does not include an autoloader (320; FIG. 3). Rather, the present ink supply system includes a manual cartridge receiving system (610). As illustrated in FIG. 6, according to one exemplary embodiment, the cartridge reception recess (638) configured to receive and facilitate the piercing of an ink supply cartridge (625) is coupled to a manual cartridge receiving system (610) by a spring (620). According to this exemplary embodiment, when an additional ink supply cartridge (625) is requested to replenish the ink reservoir (635), a user may manually insert the ink supply cartridge (625) onto the manual cartridge receiving system (610). Upon insertion, the ink supply cartridge (625) is placed against an end stop extrusion (615) expanding the spring (620). When the ink supply cartridge (625) is in place, the force of the spring (620) in conjunction with the end stop extrusion (615), forces the ink supply cartridge (625) against the fluid interconnect probe (640), thereby piercing the septum cap (410; FIG. 4) of the ink supply cartridge (625) allowing ink (420; FIG. 4) to flow into the ink reservoir (635) of the carriage assembly (630) as described above.

Figure 7:
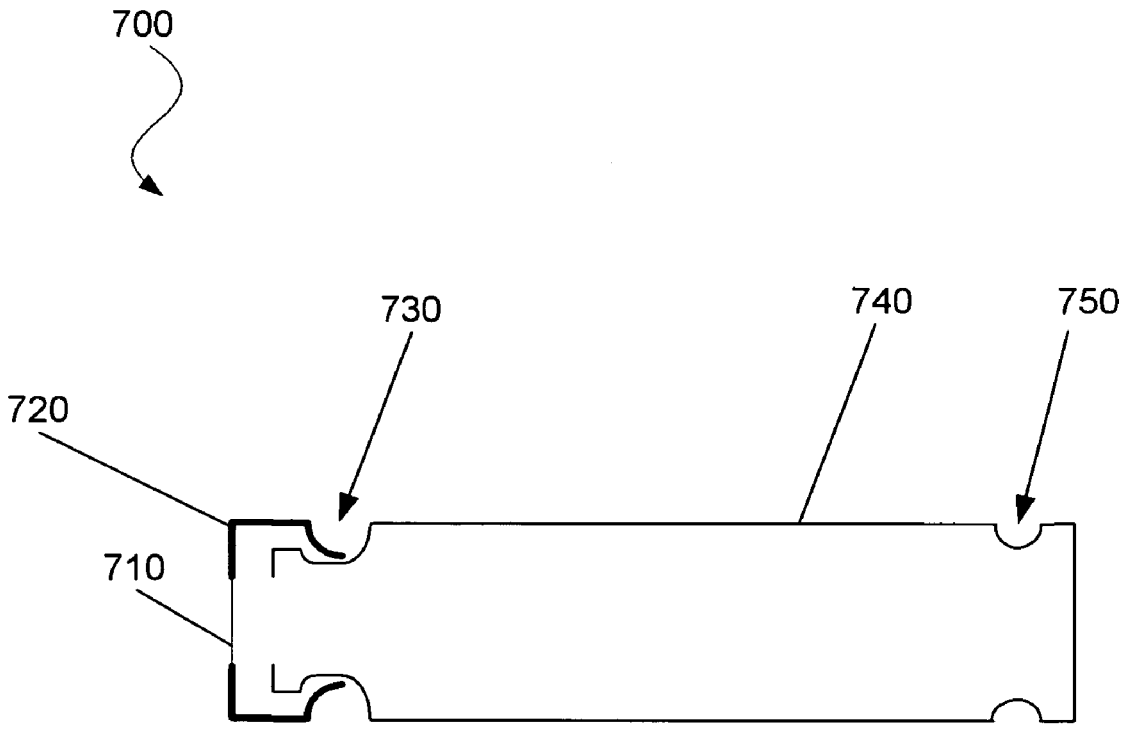
FIG. 7 is a simple block diagram illustrating the individual components of an ink supply cartridge according to one exemplary embodiment.

An alternative embodiment of the ink supply cartridge (700) is illustrated in FIG. 7. As shown in FIG. 7, a glass vial (740) may be manufactured inexpensively to serve as an ink supply cartridge (700). As shown in FIG. 7, the alternative ink supply cartridge (700) may be very similar to an insulin bottle as used by diabetics and include a glass vial shell (740) configured to house an ink supply, a circumferential groove (750) around its base enabling an autoloader mechanism (320; FIG. 3) to easily insert and retract the cartridge (700) from an ink supply cartridge reception recess (338; FIG. 3). Additionally, according to one exemplary embodiment, the ink supply cartridge (700) would include a septum (710) held onto the glass vial shell (740) by a crimped metal cap (720) as illustrated in FIG. 7.

According to one exemplary embodiment of the ink supply cartridge (700) illustrated in FIG. 7, many possible materials may be used to form the septum (710). Final choice would be greatly influenced by interactions with particular inks. However, the material used may include, but is in no way limited to, poly-isoprene. Similarly, there are many possible choices of material for the vial shell (740). When selecting the material used to form the vial shell (740), low water vapor transmission rate and lack of interaction with the ink should be considered. According to one exemplary embodiment, the material used to form the vial shell (740) may include, but is in no way limited to, glass, LCP, and/or PPS.

Additionally, a bladder may be incorporated into the exemplary configuration illustrated in FIG. 7. However, a bladder may or may not be needed depending on the design of the ink supply cartridge reception recess (338; FIG. 3) used. For example, no bladder may be needed if the ink supply cartridge reception recess (338; FIG. 3) includes a dual needle design.

In conclusion, the present system and method effectively allow for both high and low ink use printing systems to use a single universal carriage assembly. More specifically, the present system and method incorporate an ink supply system that includes one or more small ink supply cartridges that may be independently accessed on-axis by a carriage assembly to provide ink to an associated print head. According to the present system and method, the ink supply system is an on-axis system that effectively reduces the amount of ink that is translated by the servo mechanisms in a printing device. Consequently, the size of the carriage drive motor and other servo mechanisms can be reduced because they are moving less mass. This reduction in mass also reduces the amount of overtravel required to accurately position the carriage assembly. Reduced size in the carriage drive motor and other servo mechanisms as well as in the amount of case material reduces overall cost of the printing device.

Additionally, one exemplary embodiment of the present system and method incorporates an autoloader mechanism that allows several ink supply cartridges to be stacked in the printing device, thereby allowing a large quantity of ink to be available to the carriage assembly without direct intervention by a user.

Moreover, the incorporation of a single universal ink supply cartridge for all applications reduces ink supply manufacturing costs. By incorporating a single, universal ink supply cartridge size in both high ink use applications and low ink use applications, manufacture of the ink supply cartridges may be streamlined.

The preceding description has been presented only to illustrate and describe exemplary embodiments of the present system and method. It is not intended to be exhaustive or to limit the present system and method to any precise form disclosed. Many modifications and variations are possible in light of the above teaching. It is intended that the scope of the present system and method be defined by the following claims.

What is claimed is:

1. A system for providing ink to a printing device comprising:

a carriage including a fluid interconnect probe;

a plurality of ink supply cartridges;

an ink supply cartridge magazine, said ink supply cartridge magazine being configured to house said plurality of ink supply cartridges; and an autoloader configured to fluidly couple successive ink supply cartridges from said magazine to said carriage using said fluid interconnect probe.

2. The system of claim 1, wherein said carriage including a fluid interconnect probe comprises:

an ink reservoir;

a print head fluidly coupled to said ink reservoir; and a cartridge reception recess;

wherein said fluid interconnect probe is fluidly coupled to said ink reservoir and configured to pierce a septum of a said ink supply cartridge disposed in said cartridge reception recess.

3. The system of claim 2, wherein said print head further comprises one of a thermally activated inkjet material dispenser, a mechanically activated inkjet material dispenser, an electrically activated inkjet material dispenser, a magnetically activated material dispenser, or a piezoelectrically activated material dispenser.

4. The system of claim 1, wherein said ink supply cartridge comprises:

a hollow casing including a body, a proximal end, and a distal end;

a bladder configured to contain a quantity of ink disposed in said body; and a pierceable septum configured to seal said ink into said bladder.

5. The system of claim 4, wherein said casing comprises a cylinder.

6. The system of claim 5, wherein said ink supply cartridge is configured to contain between 2 and 5 cubic centimeters of ink.

7. The system of claim 4, wherein said hollow casing comprises one of a thermoplastic, a glass, a liquid crystal polymer (LCP), or a polyphenylene sulfide (PPS).

8. The system of claim 4, wherein said pierceable septum comprises one of a rubber, a poly-isoprene, or a foil.

9. The system of claim 4, wherein said hollow casing further comprises:

a circumferential groove disposed on said proximal end of said hollow casing;

said circumferential groove being configured to be engaged by said autoloader.

10. The system of claim 4, wherein greater than ambient pressure is provided inside said body such that, when said septum is pierced, said greater than ambient pressure forces ink from said bladder.

11. The system of claim 4, further comprising a foil outer layer over said septum.

12. The system of claim 1, wherein said autoloader further comprises:

a retention extrusion configured to securely couple a circumferential groove disposed on a proximal end of a said ink supply cartridge; and an ejection pin configured to eject a said ink supply cartridge from said autoloader.

13. The system of claim 1, wherein said autoloader is coupled to a solenoid configured to provide translation to said autoloader.

14. The system of claim 1, further comprising an empty canister holding bin configured to accommodate a plurality of ink supply cartridges ejected from said autoloader.

15. The system of claim 1, wherein said ink supply cartridge magazine is configured to house said plurality of ink supply cartridges adjacent to said autoloader such that gravity facilitates loading of said successive ink supply cartridges from said magazine into said autoloader.

16. The system of claim 1, wherein said ink supply cartridge magazine further comprises a spring configured to selectively eject said ink supply cartridges.

17. The system of claim 16, wherein said ink supply cartridge magazine further comprises an escapement mechanism configured to selectively resist said ejection of said ink supply cartridges from said ink supply cartridge magazine.

18. The system of claim 1, wherein said carriage further comprises;

said first probe fluidly coupled to an ink reservoir of said carriage.

19. The system of claim 1, wherein said carriage further comprises a plurality of probes, wherein each of said probes is in fluid communication with an independent print head; and wherein each of said plurality of probes is configured to receive ink from a separate ink supply cartridge.

20. the system of claim 19, wherein each of said plurality of probes is configured to receive ink of an independent color.

21. The system of claim 1, wherein said magazine is molded into a case of said printing device.

22. The system of claim 1, wherein said magazine is removable from said printing device.

23. The system of claim 1, further comprising a sensor for determining when an ink supply cartridge coupled to said carriage is empty, wherein said autoloader then couples a next ink supply cartridge to said carriage in response to output from said sensor.

24. A system for providing ink to a printing device comprising:

a carriage including a means for storing ink fluidly coupled to a fluid interconnect probe;

a plurality of means for containing ink separate from said carriage;

a means for containing and successively dispensing said means for containing ink; and a means for automatically coupling each successively dispensed means for containing ink to said fluid interconnect probe of said carriage.

25. The system of claim 24, wherein said carriage including a fluid interconnect probe comprises:

a means for storing ink; and a means for selectively ejecting ink fluidly coupled to said ink storing means;

wherein said fluid interconnect probe is configured to pierce a septum of said ink containment means.

26. The system of claim 25, wherein said selective ink ejecting means further comprises one of a thermally activated inkjet material dispenser, a mechanically activated inkjet material dispenser, an electrically activated inkjet material dispenser, a magnetically activated material dispenser, or a piezoelectrically activated material dispenser.

27. The system of claim 24, wherein said ink containment means further comprises:

a hollow casing including a body, a proximal end, and a distal end;

a bladder configured to contain a quantity of ink; and a pierceable septum configured to seal said ink into said bladder.

28. The system of claim 27, wherein said hollow casing further comprises:

a circumferential groove disposed on said proximal end of said hollow casing;

said circumferential groove being configured to be engaged by said means for automatically coupling said means for containing ink to said fluid interconnect probe.

29. The system of claim 24, wherein said means for automatically coupling said means for containing ink to said fluid interconnect probe further comprises:

a means for securely engaging a circumferential groove disposed on a proximal end of said ink containment means; and a means for ejecting said ink containment means when emptied.

30. The system of claim 24, wherein said means for containing and dispensing said means for containing ink utilize gravity for selectively ejecting said successive means for containing ink.

31. The system of claim 24, wherein said means for containing and dispensing said means for containing ink comprise a spring for selectively ejecting said successive means for containing ink.

32. The system of claim 31, wherein said means for containing and successively dispensing said means for containing ink further comprise an escapement mechanism configured to selectively resist said ejection of said ink containment means.

33. A method for providing small amounts of on demand on-axis ink to a printing device comprising:

coupling a stack of ink supply cartridges to said printing device;

coupling an autoloader to a carriage of said printing device; and fluidly coupling one of said ink supply cartridges to said carriage with said autoloader.

34. The method of claim 33, wherein said step of fluidly coupling one of said ink supply cartridges to said carriage with said autoloader further comprises:

releasing one of said ink supply cartridges from said stack onto said autoloader;

securely coupling said ink supply cartridge to said autoloader;

translating said ink supply cartridge to said carriage; and piercing a surface of said ink supply cartridge such that said ink supply cartridge is fluidly coupled to said carriage.

35. The method of claim 33, further comprising ejecting an empty ink supply cartridges into a cartridge holding bin.

* * * * *

UNITED STATES PATENT AND TRADEMARK OFFICE

CERTIFICATE OF CORRECTION

PATENT NO. : 7,322,683 B2
APPLICATION NO. : 10/976554
DATED : January 29, 2008
INVENTOR(S) : Daniel W. Youngberg It is certified that error appears in the above-identified patent and that said Letters Patent is hereby corrected as shown below:

In column 11, line 55, in Claim 13, after "provide" insert -- linear --.

In column 12, line 15, in Claim 20, delete "the" and insert -- The --, therefor.

Signed and Sealed this

Fifth Day of August, 2008

JON W. DUDAS
*Director of the United States Patent and Trademark Office*